US009241538B2

(12) United States Patent
Jacobs

(10) Patent No.: US 9,241,538 B2
(45) Date of Patent: Jan. 26, 2016

(54) BOOT BRA

(76) Inventor: Rebecca K. Jacobs, Boston, MA (US)

( * ) Notice: Subject to any disclaimer, the term of this patent is extended or adjusted under 35 U.S.C. 154(b) by 152 days.

(21) Appl. No.: 13/560,561

(22) Filed: Jul. 27, 2012

(65) Prior Publication Data

US 2013/0025163 A1 Jan. 31, 2013

Related U.S. Application Data

(60) Provisional application No. 61/512,455, filed on Jul. 28, 2011.

(51) Int. Cl.

| | |
|---|---|
| ***A43B 23/02*** | (2006.01) |
| ***A43B 3/00*** | (2006.01) |
| ***A43B 7/08*** | (2006.01) |
| ***A43B 1/10*** | (2006.01) |
| ***A43B 5/04*** | (2006.01) |
| ***A43C 11/10*** | (2006.01) |
| ***A43B 3/02*** | (2006.01) |
| ***A43C 11/08*** | (2006.01) |
| ***A43C 11/14*** | (2006.01) |

(52) U.S. Cl.

CPC . *A43C 11/10* (2013.01); *A43B 3/02* (2013.01); *A43C 11/08* (2013.01); *A43C 11/14* (2013.01)

(58) Field of Classification Search

CPC ..... A43B 3/02; A43B 3/08; A43B 3/04; A43B 3/16; A43B 3/163; A43B 3/18; A41D 17/00

USPC ..... 36/119, 109, 118.1–118.5, 2; 602/28; 2/239, 240–243, 300

See application file for complete search history.

(56) References Cited

U.S. PATENT DOCUMENTS

| | | | | | |
|---|---|---|---|---|---|
| 2,230,291 | A | * | 2/1941 | Evans | 36/7.3 |
| 2,455,801 | A | * | 12/1948 | Olson | 36/4 |
| 2,473,099 | A | * | 6/1949 | Hatch | 36/1 |
| 3,329,966 | A | * | 7/1967 | Slavick | 2/2.15 |
| 3,475,835 | A | * | 11/1969 | Kovar | 36/1.5 |
| 3,665,619 | A | * | 5/1972 | Gray | 36/117.1 |
| 4,006,543 | A | * | 2/1977 | Post | 36/117.1 |
| 4,244,121 | A | * | 1/1981 | Adams | 36/2 R |
| 4,306,315 | A | * | 12/1981 | Castiglia | 2/22 |
| 4,447,968 | A | * | 5/1984 | Spademan | 36/109 |
| 4,667,344 | A | * | 5/1987 | Cooper, III | 2/79 |

(Continued)

OTHER PUBLICATIONS

PVCS physical properties document.*

(Continued)

*Primary Examiner* — Robert J Hicks
*Assistant Examiner* — Timothy K Trieu
(74) *Attorney, Agent, or Firm* — Modern Times Legal; Robert J. Sayre

(57) ABSTRACT

A boot bra for securing an upper portion of a boot while worn by a user can include an elastic band in the form of or configurable as a ring. The elastic band can be in the form of a continuous ring or can have a first wrap engagement member (e.g., hooks) mounted at a first end and a second wrap engagement member (e.g., loops into which the hooks can be latched) mounted at a second end of the elastic band and configured to securely engage the first wrap engagement member when the elastic band is wrapped around a human leg to form the ring. A first boot-to-band engagement member (e.g., snap member) is mounted to the elastic band; and a boot mount includes a second boot-to-band engagement member (e.g., snap member) configured for secure engagement with the engagement member on the elastic band.

17 Claims, 5 Drawing Sheets

(56) References Cited

U.S. PATENT DOCUMENTS

| | | | | | |
|---|---|---|---|---|---|
| 4,669,126 | A * | 6/1987 | Jones | 2/22 |
| 4,856,207 | A * | 8/1989 | Datson | 36/2 R |
| 4,858,342 | A * | 8/1989 | Nicholson et al. | 36/109 |
| 4,912,860 | A * | 4/1990 | Keller | 36/4 |
| 5,010,597 | A * | 4/1991 | Glover | 2/242 |
| RE33,966 | E * | 6/1992 | Robison | 2/82 |
| 5,361,411 | A * | 11/1994 | Bohn et al. | 2/69 |
| 5,896,676 | A * | 4/1999 | Barousse | 36/2 R |
| 5,987,778 | A * | 11/1999 | Stoner | 36/1.5 |
| 6,026,516 | A * | 2/2000 | Dacyshyn | 2/323 |
| 6,049,913 | A * | 4/2000 | Harrigan, Jr. | 2/227 |
| 6,094,842 | A * | 8/2000 | Borel | 36/115 |
| 6,213,920 | B1 * | 4/2001 | Ronca et al. | 482/105 |
| 6,691,434 | B1 * | 2/2004 | Couturier | 36/117.1 |
| 6,851,203 | B2 * | 2/2005 | Roelofs | 36/1.5 |
| D521,212 | S * | 5/2006 | Williams | D2/901 |
| 7,069,670 | B1 * | 7/2006 | Gerke | 36/2 R |
| 7,530,182 | B2 * | 5/2009 | Munns | 36/131 |
| 7,739,751 | B2 * | 6/2010 | Lin | 2/227 |
| 7,908,767 | B1 * | 3/2011 | Mordecai et al. | 36/1.5 |
| 8,464,367 | B1 * | 6/2013 | Mordecai et al. | 2/458 |
| 8,529,484 | B2 * | 9/2013 | Savard et al. | 602/28 |
| 2003/0097765 | A1 * | 5/2003 | Chen | 36/2 R |
| 2005/0126047 | A1 * | 6/2005 | Kruijsen | 36/118.5 |
| 2005/0234378 | A1 * | 10/2005 | Ingimundarson et al. | 602/23 |
| 2006/0094334 | A1 * | 5/2006 | Davis et al. | 450/58 |
| 2006/0117598 | A1 * | 6/2006 | Czaplewski et al. | 36/2 R |
| 2006/0270958 | A1 * | 11/2006 | George | 602/28 |
| 2007/0010773 | A1 * | 1/2007 | Watts | 602/27 |
| 2008/0171956 | A1 * | 7/2008 | Jacobsen et al. | 602/28 |
| 2008/0312571 | A1 * | 12/2008 | Waller | 602/27 |
| 2009/0105624 | A1 * | 4/2009 | Warner | 602/28 |
| 2010/0248588 | A1 * | 9/2010 | Knittel | 450/82 |
| 2013/0025163 | A1 * | 1/2013 | Jacobs | 36/109 |

OTHER PUBLICATIONS

Website: https://www.dropbox.com/s/8k7rji7eoo5z6hh/BootBra-final-1080p.mp4?dl=0; Video of the invention prototype. posted online at Nov. 11, 2015.*

Royal, Monika, "Tip: How to Keep Slouchy Boots Up" (visited Jun. 23, 2011), {such a} redkatblonde, <http://www.redkatblonde.com/> (Jan. 4, 2010).

Beautifulpurpose, "High Rise Boot Straps No More Slouching Boots" (visited Jun. 23, 2011), Etsy, <http://www.etsy.com/listing/72220206/high-rise-boot-straps-no-more-slouching> (Apr. 21, 2011).

* cited by examiner

BOOT BRA

RELATED APPLICATION

This application claims the benefit of U.S. Provisional Application No. 61/512,455, filed 28 Jul. 2011, the entire content of which is incorporated herein by reference.

BACKGROUND

Boots are a popular form of footwear for both men and women. Many boots, particularly women's boots, do not have a particularly stiff construction and do not maintain their form when worn throughout the day, as the sidewalls of the boot may tend to slide down the wearer's leg. This "scrunching" of the boot may be uncomfortable for the wearer and may detract from the appearance of the boot.

SUMMARY

A "boot bra" for comfortably maintaining a boot at a fixed height (preventing vertical collapse) on the wearer's leg and a method for using the boot bra are described herein. Various embodiments of the apparatus and method may include some or all of the elements, features and steps described below.

An embodiment of a boot bra for securing an upper portion of a boot while worn by a user includes an elastic band in the form of or configurable as a ring and having a tensile elasticity to allow expansion of its diameter. The elastic band can be configured with a first end and a second end, with a first wrap engagement member (e.g., hooks) mounted at the first end and a second wrap engagement member (e.g., loops) mounted at the second end of the elastic band and configured to securely engage the first wrap engagement member when the elastic band is wrapped around a human leg to form the ring. Alternatively, the elastic band can be in the form of a continuous ring that can be slipped over a human foot and up the leg. A first boot-to-band engagement member (e.g., a first snap member) is mounted to the elastic band; and a boot mount that can be mounted inside an upper portion of a boot includes a second boot-to-band engagement member (e.g., a second snap member complementary to the first) configured for secure engagement with the first boot-to-band engagement member.

In use, an elastic band that has a first boot-to-band engagement member is secured around a human calf or thigh; and the first boot-to-band engagement member is securely engaged to a second boot-to-band engagement member mounted to an inner surface of a boot worn by the human and extending the boot up to the human's calf or thigh.

BRIEF DESCRIPTION OF THE DRAWINGS

In the accompanying drawings, like reference characters refer to the same or similar parts throughout the different views. The drawings are not necessarily to scale, emphasis instead being placed upon illustrating particular principles, discussed below.

DETAILED DESCRIPTION

Figure 1:
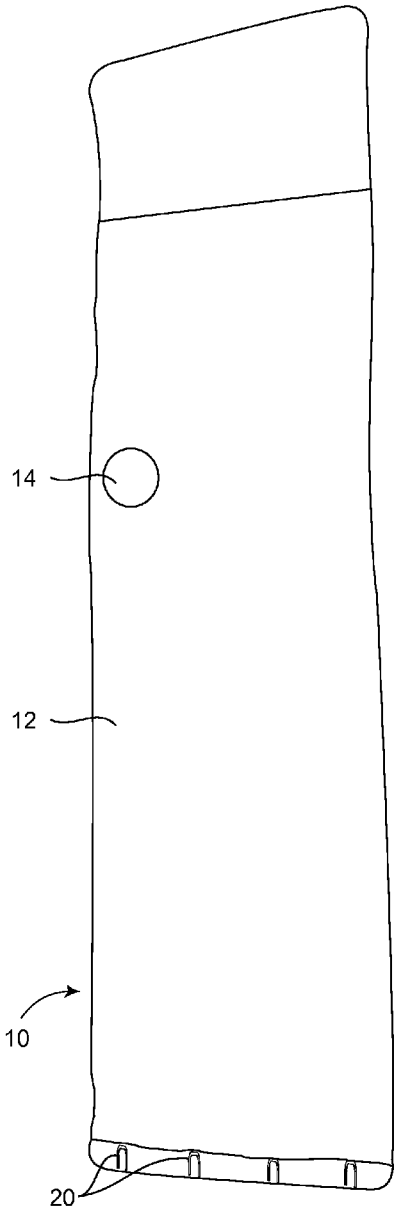
FIG. 1 is an illustration of an embodiment of the elastic band of the boot bra showing the side of the elastic band that contacts the wearer's leg with hooks on the left side.

The foregoing and other features and advantages of various aspects of the invention(s) will be apparent from the following, more-particular description of various concepts and specific embodiments within the broader bounds of the invention (s). Various aspects of the subject matter introduced above and discussed in greater detail below may be implemented in any of numerous ways, as the subject matter is not limited to any particular manner of implementation. Examples of specific implementations and applications are provided primarily for illustrative purposes.

Unless otherwise defined, used or characterized herein, terms that are used herein (including technical and scientific terms) are to be interpreted as having a meaning that is consistent with their accepted meaning in the context of the relevant art and are not to be interpreted in an idealized or overly formal sense unless expressly so defined herein. For example, if a particular composition is referenced, the composition may be substantially, though not perfectly pure, as practical and imperfect realities may apply; e.g., the potential presence of at least trace impurities (e.g., at less than 1 or 2% by weight or volume) can be understood as being within the scope of the description; likewise, if a particular shape is referenced, the shape is intended to include imperfect variations from ideal shapes, e.g., due to manufacturing tolerances.

Although the terms, first, second, third, etc., may be used herein to describe various elements, these elements are not to be limited by these terms. These terms are simply used to distinguish one element from another. Thus, a first element, discussed below, could be termed a second element without departing from the teachings of the exemplary embodiments.

Spatially relative terms, such as "above," "upper," "beneath," "below," "lower," and the like, may be used herein for ease of description to describe the relationship of one element to another element, as illustrated in the figures. It will be understood that the spatially relative terms, as well as the illustrated configurations, are intended to encompass different orientations of the apparatus in use or operation in addition to the orientations described herein and depicted in the figures. For example, if the apparatus in the figures is turned over, elements described as "below" or "beneath" other elements or features would then be oriented "above" the other elements or features. Thus, the exemplary term, "above," may encompass both an orientation of above and below. The apparatus may be otherwise oriented (e.g., rotated 90 degrees or at other orientations) and the spatially relative descriptors used herein interpreted accordingly.

Further still, in this disclosure, when an element is referred to as being "on," "connected to", "coupled to", or "mounted to" another element, it may be directly on, connected or coupled to, or integrated with the other element or intervening elements may be present unless otherwise specified.

The terminology used herein is for the purpose of describing particular embodiments and is not intended to be limiting of exemplary embodiments. As used herein, singular forms, such as "a" and "an," are intended to include the plural forms as well, unless the context indicates otherwise. Additionally, the terms, "includes," "including," "comprises" and "comprising," specify the presence of the stated elements or steps but do not preclude the presence or addition of one or more other elements or steps.

The boot bra, as described herein and illustrated in FIGS. 1-8, can be provided in the form of a kit including at least two complementary members, a first member 10 including an elastic band 12 (formed, e.g., of an elastic fabric) that encircles a wearer's calf or thigh and a first boot-to-band engagement member 14 mounted to (for example, adhered to, embedded in, incorporated into, etc.) the elastic band 12 and a boot mount 16 including a second boot-to-band engagement member 17, wherein the boot mount 16 is mounted to the inward-facing surface 24 of the sidewall of a boot 18. In particular embodiments, each kit includes two boot bras (i.e., two complementary members 10 and 16 for a left boot 18 and two complementary members 10 and 16 for a right boot 18).

The first member 10 in each complementary pair, shown in FIGS. 1-6, can have a length of, e.g., about 11 inches (~28 cm). The first member 10 includes an elastic band 12 with a width, e.g., between 2 and 4 inches (5 and 10 cm), such as 3 inches (7.6 cm). The elastic band 12 can be in a knitted form and can be formed, e.g., of about 80% polyester and about 20% rubber. Suitable elastic fabrics can be purchased in roll form, e.g., from Joann Fabrics (Heavy Duty Elastic 3"W×10 yd) via their website at www.joann.com or from CTS (3" Knitted Elastic Roll 50 yds) via their website at www.ctsusa-.com. Individual elastic bands 12 can then be formed by cutting the elastic fabric into strips 8-12 inches [e.g., 9 inches (23 cm) long as the fabric is unrolled from the roll. In alternative embodiments, the elastic band 12 can be in the form of a continuous elongated ring (i.e., as you would have if you joined the two ends of the elastic band 12), through which a wearer can slip her foot and which she can then slide up her leg. The ring, when un-stretched, can have a diameter of, for example, 8-10 inches.

Figure 2:
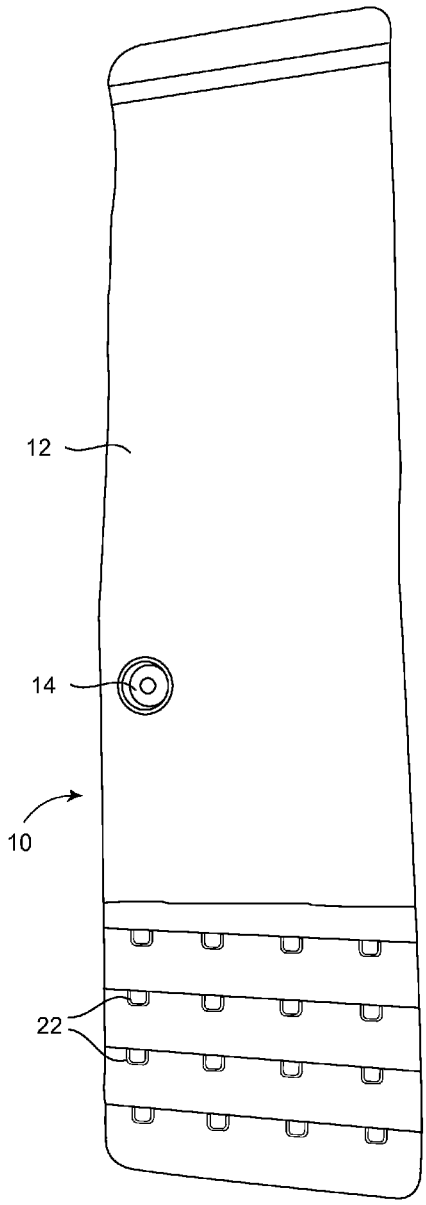
FIG. 2 is an illustration of the opposite side of the elastic band of the boot bra showing the open side of the snap member and loops (on the left side) for engaging with the hooks.
Figure 3:
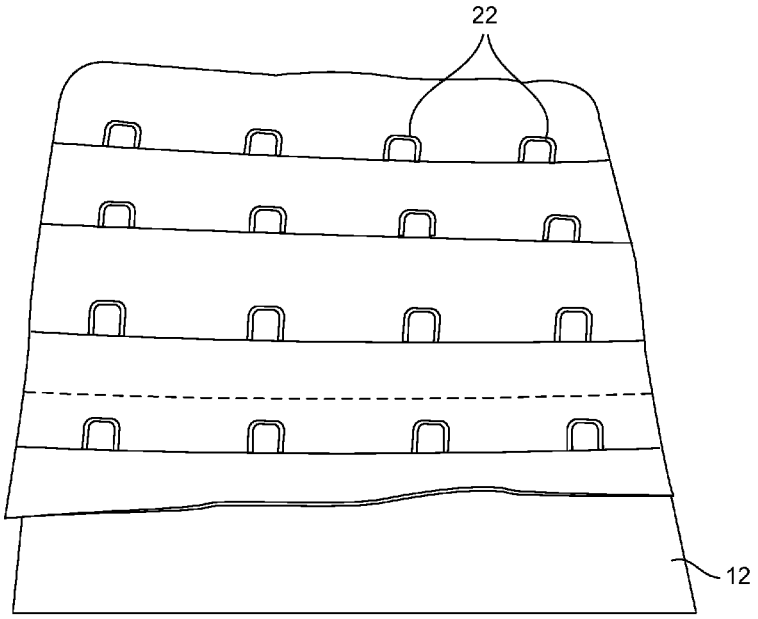
FIG. 3 is a magnified illustration of the loops shown at the end of the band in FIG. 2.
Figure 4:
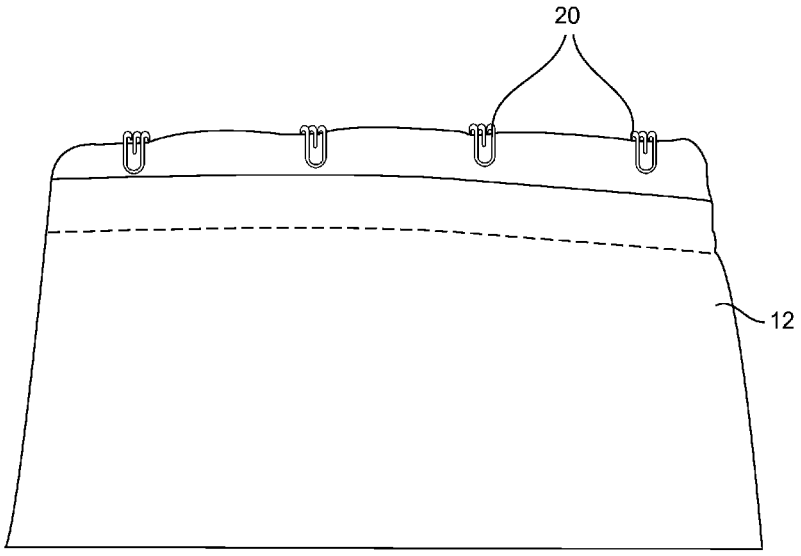
FIG. 4 is a magnified illustration of the hooks shown at the other end of the band in FIG. 1.
Figure 8:
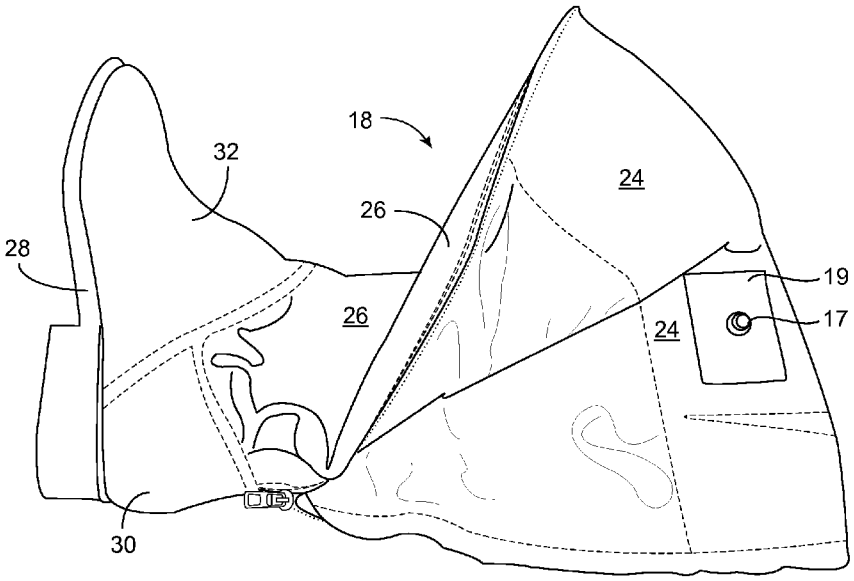
FIG. 8 is an illustration of a boot with the snap member and adhesive substrate of FIG. 7 adhered to its sidewall.

A first boot-to-band-engagement member 14 (e.g., in the form of a snap member) can be affixed to (e.g., punched through) the elastic band 12, as shown from opposite sides in FIGS. 1 and 2, using a heavy-duty snap attacher. The snap member 14 affixed to the elastic band 12 is configured to snap into a second snap member 17 affixed to an inward-facing surface 24 of the sidewall of a boot 18, as described below and as shown in FIG. 8. Each snap member 14/17 an have a diameter of, e.g., ⅝ of an inch (1.6 cm), and suitable snaps are available, e.g., from Prym-Dritz Corp., Spartanburg, S.C.

The elastic band 12 includes wrap-engagement members 20, 22 for forming a ring. In the embodiments of FIGS. 1-6, the wrap-engagement members 20, 22 are in the form of interlocking hooks 20 and loops 22. Affixed to the elastic band 12 at one end (facing up on the left end in FIG. 1 and facing down on the right end in FIG. 2) is a row of hooks 20, while multiple rows of loops 22 to which the hooks 20 can be affixed is provided on the other end of the elastic band 12 (facing down on the right end in FIG. 1 and facing up on the left end in FIG. 2).

The multiple rows of loops 22 (e.g., four rows in the embodiment of FIGS. 1-6) affords formation of rings with different circumferences when the hooks 20 are engaged with loops 22. Accordingly, the size of the resulting ring can be adjusted via loop-row selection to approximately match the particular circumference of the wearer's calf (for a calf-high boot) or of the wearer's thigh (for a thigh-high boot) with the desired level of tension. For example, a very-thin boot wearer may affix the hooks 20 to the inner-most row of loops 22, while a more-rotund boot wearer may affix the hooks 20 to the outer-most row of loops 22. Likewise, any particular wearer may use a row of loops 22 closer to the center for the calf and a row of loops 22 closer to the end for the thigh (in cases where the diameter of the user's thigh is larger than the diameter of her calf).

Figure 5:
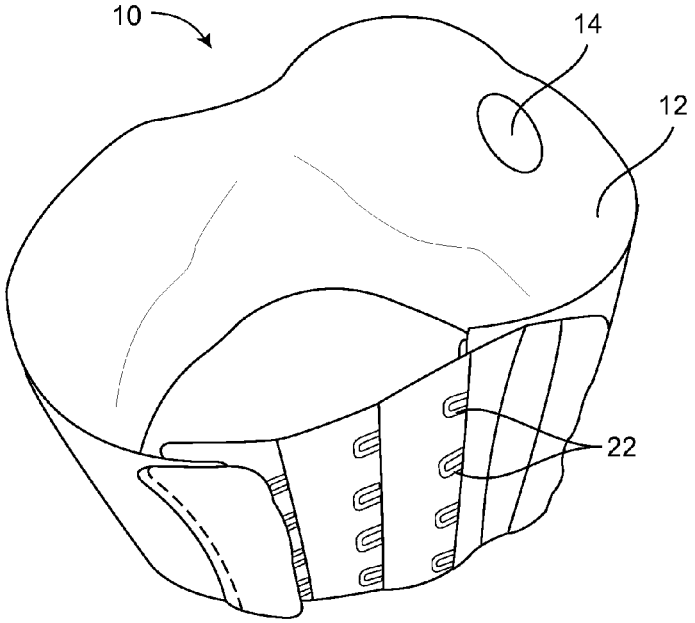
FIGS. 5 and 6 provide a pair of illustrations from different perspectives of the elastic band with the hooks on one end engaged with loops on the other end to form a ring.
Figure 6:
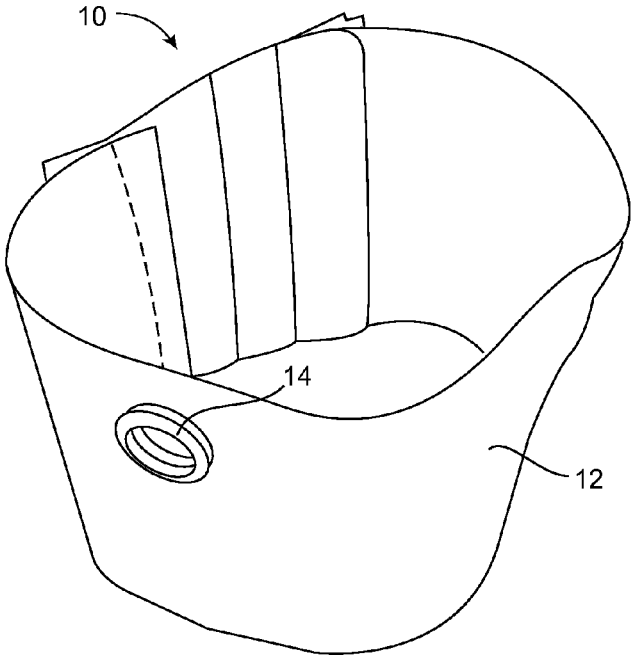
Figure 9:
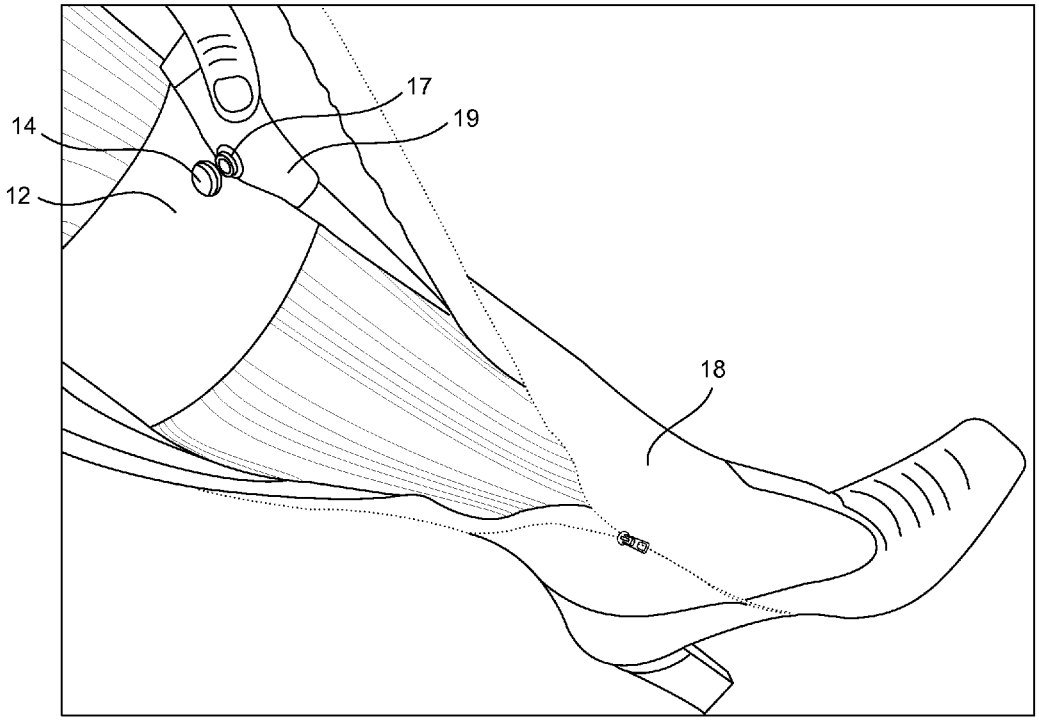
FIG. 9 is an illustration of a boot with a boot mount adhered to an inward-facing surface of the boot sleeve, wherein a snap member on the boot mount is being secured to a complementary snap member on an elastic band worn around the calf of a human wearing the boot.

In one embodiment, the row of hooks 20 and the rows of loops 22 can be provided by cutting a brassiere-back (bra-back) extender in two between the hooks 20 and the loops 22. One example of a bra-back extender that can be modified for this purpose is the 3-inch (7.5 cm) wide soft bra-back extender from Prym-Dritz Corp., Spartanburg, SC. The resulting section with the rows of loops 22 can have a length (measured vertically in the orientation of FIG. 3), e.g., of about 2.5 inches (6.4 cm), with the rows of loops 22 positioned at intervals of about 1.5 cm along the length. Meanwhile, the resulting section with the hooks 20 can have a length, e.g., of about 1.5 cm. The two sections (with the hooks 20 and loops 22, respectively) can then be sewn to the elastic band 12 at opposite ends or affixed with fabric glue. If the hooks 20 are affixed to face upward with the band 12 resting on a flat surface, the loops 22 are affixed to face downward, and vice versa, so that the hooks 20 and loops 22 can be engaged without twisting the band 12 when the band 12 is wrapped to form of a ring (e.g., around a calf or thigh), as shown in FIGS. 5, 6, and 9. In alternative embodiments, multiple rows of hooks 20 can be provided at one end while a single row of loops 22 are provided at the other end of the elastic band 12 to provide the same adjustability.

Figure 7:
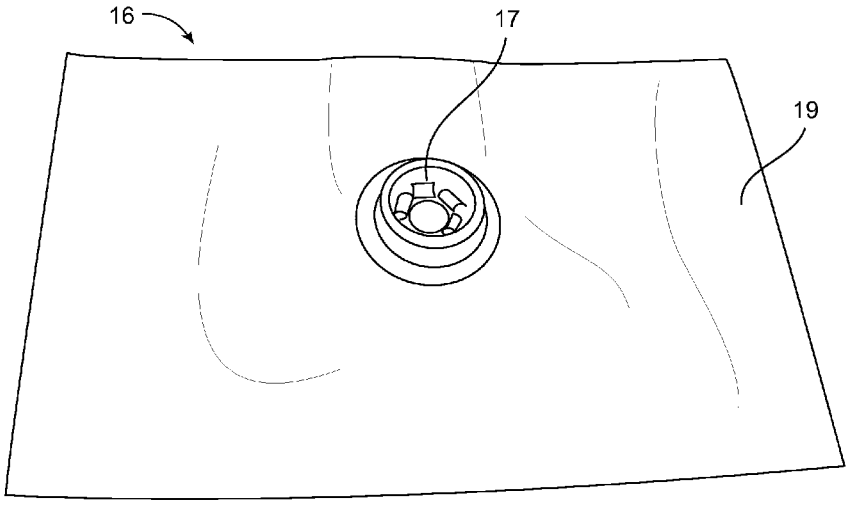
FIG. 7 is an illustration of a second snap member on an adhesive substrate for mounting to the interior sidewall of a boot so that the second snap member can engage with the first snap member to couple the boot sidewall with the elastic band and thereby fix the vertical position of the boot sidewall.

The second of the two members of each boot bra, as shown in FIG. 7, is a boot mount 16 including a substrate 19 with adhesive on one side and a second boot-to-band-engagement member 17 in the form of a second snap member for engaging with the first snap member on the elastic band 12. The substrate 19 can be in the form of a strip of tape with a strong adhesive, such as GORILLA tape (available from Gorilla Glue, Inc., of Cincinnati, Ohio) with a width, e.g., of two inches (5 cm) and cut into strips having a length, e.g., of three inches (7.6 cm).

As packaged in the kit, the side of the substrate 19 that is coated with adhesive is adhered to a removable low-stick surface (e.g., wax paper or another conventional form of tape backing). To semi-permanently attach the boot mount 16 to the boot 18, the user can detach the removable low-stick surface from the adhesive side of the substrate 19 and then firmly press the adhesive side of the substrate 19 onto the inward-facing surface 24 of the sidewall of the boot 18, as shown in FIGS. 8 and 9. In other embodiments, the substrate 19 can be secured by other means (e.g., sewn on) or the second snap member 17 can be punched through the sidewall of the boot 18, though an advantage of using an adhesive substrate 19 is that it need not leave any visible trace of the second boot-to-band engagement member 17 on the outward-facing surface 26 of the sidewall of the boot 18, and its attachment need not damage the boot 18. As illustrated in FIG. 8, the boot18 also includes a sole 28, a quarter 30 configured to cover the wearer's heel, and a vamp 32 configured to cover the front of the wearer's foot.

With the boot mount 16 and its second boot-to-band-engagement member 17 affixed to the inward-facing surface 24 of the sidewall of the boot 18, the boot 18 can be secured to the wearer's leg to hang with a full, fixed and secured extension from the wearer's calf or thigh by (a) wrapping the elastic band 12 around the wearer's calf or thigh, (b) securing the hooks 20 into a row of loops 22 to form a ring with the desired circumference, (c) sliding the boot 18 over the wearer's foot with the sidewalls extending up the wearer's leg, and then (d) snapping the first snap member on the elastic band 12 onto the second snap member affixed to the inside of the sidewall of the boot 18. This process can then be repeated for the other boot 18 to be worn on the wearer's other foot. In embodiments where the elastic band 12 is in the form of a ring, the wearer can simply slide the elastic band 12 over her foot and up her leg and continue with step (c) in the above method.

In describing embodiments of the invention, specific terminology is used for the sake of clarity. For the purpose of description, specific terms are intended to at least include technical and functional equivalents that operate in a similar manner to accomplish a similar result. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Further, where parameters for various properties are specified herein for embodiments of the invention, those parameters can be adjusted up or down by $1/100^{th}$, $1/50^{th}$, $1/20^{th}$, $1/10^{th}$, $1/5^{th}$, $1/3^{rd}$, 1/2, $3/4^{th}$, etc. (or up by a factor of 2, 5, 10, etc.), or by rounded-off approximations thereof, unless otherwise specified. Moreover, while this invention has been shown and described with references to particular embodiments thereof, those skilled in the art will understand that various substitutions and alterations in form and details may be made therein without departing from the scope of the invention. Further still, other aspects, functions and advantages are also within the scope of the invention; and all embodiments of the invention need not necessarily achieve all of the advantages or possess all of the characteristics described above. Additionally, steps, elements and features discussed herein in connection with one embodiment can likewise be used in conjunction with other embodiments. The contents of references, including reference texts, journal articles, patents, patent applications, etc., cited throughout the text are hereby incorporated by reference in their entirety; and appropriate components, steps, and characterizations from these references optionally may or may not be included in embodiments of this invention. Still further, the components and steps identified in the Background section are integral to this disclosure and can be used in conjunction with or substituted for components and steps described elsewhere in the disclosure within the scope of the invention. In method claims, where stages are recited in a particular order—with or without sequenced prefacing characters added for ease of reference—the stages are not to be interpreted as being temporally limited to the order in which they are recited unless otherwise specified or implied by the terms and phrasing.

What is claimed is:

1. A boot and boot bra for securing a sleeve of the boot while worn by a user, the boot and boot bra comprising:

an elastic band in the form of or configurable as a ring and having a tensile elasticity to allow expansion of the ring's diameter, the elastic band having one of the following configurations:

a) having a first end and a second end with a first wrap engagement member mounted at the first end and a second wrap engagement member mounted at the second end of the elastic band and configured to securely engage the first wrap engagement member when the elastic band is wrapped around a human leg to form the ring;

b) being in the form of a continuous ring that can be slipped over a human foot and up the leg;

a first boot-to-band engagement member mounted to the elastic band;

the boot comprising a sole, a vamp mounted to the sole and configured to cover front part of the human foot, a quarter mounted to the sole and configured to cover a heel of the human foot, and the sleeve extending from the quarter and the vamp away from the sole, wherein the sleeve includes an inward-facing surface and an outward-facing surface, wherein the inward-facing surface of the sleeve is configured to face toward the human leg when the boot is worn on the human leg with the sleeve encircling the human leg, wherein the outward-facing surface faces in a direction opposite from that of the inward-facing surface, wherein the outward-facing surface is configured to face away from the human leg when the boot is worn on the human leg with the sleeve encircling the human leg; and a boot mount including a second boot-to-band engagement member configured for secure engagement with the first boot-to-band engagement member, wherein the boot mount is mounted inside the sleeve of the boot to the inward-facing surface.

2. The boot and boot bra of claim 1, wherein the elastic band has the configuration with the first end and the second end with the first wrap engagement member mounted at the first end and the second wrap engagement member mounted at the second end of the elastic band and configured to securely engage the first wrap engagement member.

3. The boot and boot bra of claim 2, wherein the first boot-to-band engagement member comprises a first snap member, and wherein the second boot-to-band engagement member comprises a second snap member that securely snaps to the first snap member.

4. The boot and boot bra of claim 3, further comprising an adhesive substrate to which the second boot-to-band engagement member is mounted.

5. The boot and boot bra of claim 4, wherein the adhesive substrate is mounted to the inward-facing surface of the sleeve of the boot.

6. The boot and boot bra of claim 3, wherein the snap members have a diameter of 0.5 to 0.75 inches.

7. The boot and boot bra of claim 2, wherein the elastic band, un-stretched, has a length, measured from the first end to the second end, in the range from 8 to 10 inches.

8. The boot and boot bra of claim 7, wherein the elastic band when, un-stretched, has a width, measured orthogonal to the length, in the range from 2 to 4 inches.

9. The boot and boot bra of claim 2, wherein the elastic band comprises an elastic fabric.

10. The boot and boot bra of claim 2, wherein the first wrap engagement member comprises at least one loop, and wherein the second wrap engagement member comprises at least one hook configured to latch into the loop.

11. The boot and boot bra of claim 10, wherein the first wrap engagement member comprises a plurality of the loops, and wherein the second wrap engagement member comprises a plurality of the hooks configured to latch into the loops.

12. The boot and boot bra of claim 11, wherein the plurality of loops are configured in a plurality of rows to provide for an adjustable circumference of the boot bra depending on which row of loops is engaged with the hooks.

13. The boot and boot bra of claim 12, wherein the first wrap engagement member further comprises a first substrate to which the plurality of loops are mounted, wherein the second wrap engagement member further comprises a second substrate to which the plurality of loops are mounted, and wherein each of the first and second substrates are stitched onto the elastic band.

14. The boot and boot bra of claim 1, wherein the elastic band has the continuous ring configuration.

15. The boot and boot bra of claim 14, wherein the elastic band, when un-stretched, has a diameter of 8 to 10 inches.

16. A method for securing a sleeve of a boot to a wearer's calf or thigh, the method comprising:

securing an elastic band in the form of or configurable as a ring and having a tensile elasticity to allow expansion of the ring's diameter and having a first boot-to-band engagement member, wherein the elastic band is configured to encircle a human calf or thigh and has one of the following configurations:

a) having a first end and a second end with a first wrap engagement member mounted at the first end and a second wrap engagement member mounted at the second end of the elastic band and configured to securely engage the first wrap engagement member when the elastic band is wrapped around a human leg to form the ring; and b) being in the form of a continuous ring that can be slipped over a human foot and up the leg; and securely engaging the first boot-to-band engagement member to a second boot-to-band engagement member mounted to an inward-facing surface of the sleeve of the boot, wherein the boot is configured to be worn by the human, wherein the inward-facing surface of the sleeve is configured to face toward human leg when the boot is worn on the human leg with the sleeve encircling the human leg, wherein an outward-facing surface of the sleeve faces in a direction opposite from that of the inward-facing surface, wherein the outward-facing surface is configured to face away from the human leg when the boot is worn on the human leg with the sleeve encircling the human leg, wherein the engaged second boot-to-band engagement member is configured for positioning between the sleeve of the boot and the human's calf or thigh, wherein the boot comprises the sleeve, a sole, a vamp mounted to the sole and configured to cover a front part of the human foot, and a quarter mounted to the sole and configured to cover a heel of the human foot, wherein the sleeve extends upwardly from the quarter and the vamp away from the sole.

17. The method of claim 16, wherein the second boot-to-band engagement member is mounted to an adhesive substrate, the method further comprising adhering the adhesive substrate to the inward-facing surface of the sleeve of the boot before engaging the first and second boot-to-band engagement members.

* * * * *